United States Patent [19]

Scott et al.

[11] 4,292,469

[45] Sep. 29, 1981

[54] VOICE PITCH DETECTOR AND DISPLAY

[75] Inventors: Brian L. Scott; Lee H. Hardesty, both of Denton, Tex.

[73] Assignee: Scott Instruments Company, Denton, Tex.

[21] Appl. No.: 48,238

[22] Filed: Jun. 13, 1979

[51] Int. Cl.[3] ..... G10L 1/00

[52] U.S. Cl. ..... 179/1 SC; 179/1 SP

[58] Field of Search ..... 179/1 SC, 1 SP, 1 VL, 179/1 SA, 1 D; 330/302, 303; 329/110

[56] References Cited

U.S. PATENT DOCUMENTS

| | | | |
|---|---|---|---|
| 3,215,934 | 11/1965 | Sallen | 324/77 |
| 3,327,057 | 6/1967 | Coker | 179/1 SA |
| 3,499,991 | 3/1970 | Cassel et al. | 179/1 SA |
| 3,551,588 | 12/1970 | Boworth | 179/1 SA |
| 3,662,374 | 5/1972 | Harrison et al. | 179/1 SA |
| 3,855,417 | 12/1974 | Fuller | 179/1 SA |
| 3,855,418 | 12/1974 | Fuller | 179/1 SA |
| 3,971,034 | 7/1976 | Bell et al. | 179/1 SP |
| 3,978,287 | 8/1976 | Fletcher et al. | 179/1 SA |
| 4,039,754 | 8/1977 | Lokerson | 179/1 SA |
| 4,063,035 | 12/1977 | Appelman et al. | 179/1 SP |

OTHER PUBLICATIONS

M. Schroeder, "Period Histogram and Product Spectrum etc.", J. Ac. Soc. of Am., vol. 43, No. 4, 1968, pp. 829–834.

*Primary Examiner*—Mark E. Nusbaum
*Assistant Examiner*—E. S. Kemeny
*Attorney, Agent, or Firm*—Richards, Harris & Medlock

[57] ABSTRACT

Voice pitch is detected by passing a speech signal from a microphone 10 through a filter array 20 to a summing amplifier 22. The summing amplifier 22 provides a composite signal of the acoustic components of the speech signal and this composite signal is input to a multiplier 26 and from the multiplier 26 to a multiplier 36 having an output connected to a comparator 42. The comparator 42 compares the output of the multiplier 36 with a hysteresis signal, then provides an output to a phase locked loop 46. The phase locked loop 46 provides a first voltage output in analog form to a bar graph display 50 and provides a square wave output that is applied to a frequency-to-voltage converter 52 for driving a digital display 54.

21 Claims, 6 Drawing Figures

MULTIPLIER 38
MULTIPLIER 30
PHASE-LOCKED LOOP
FROM FILTER-SUM OUTPUT
TO F/V CONVERTER
PITCH DETECTOR OUTPUT (ANALOG)
REMOTE BOX
TO BAR-GRAPH DISP. INPUT
+V
-V

VOICE PITCH DETECTOR AND DISPLAY

TECHNICAL FIELD

This invention relates to a pitch detector and display and more particularly to a real time speaker independent voice pitch detector and voice pitch display.

BACKGROUND OF THE INVENTION

The spectrograph is the time-honored tool for study of speech perception for visually displaying segregated frequency patterns in space. Recently, however, there is evidence to show that many differences exist between a speech spectrograph and a neural output of a cochlea. For example, the output of the cochlea is linear up to about 1,000 Hz and logarithmic above that, whereas the spectrograph is either logarithmic or linear. Thus, there is serious question whether the temporal processing of acoustic components of speech by the ear can be demonstrated by a speech spectrogram. This is not considered to be a trivial shortcoming of the speech spectrogram given that the fundamental frequency and the first formant information of speech are coded, at least to some extent, by temporal information.

Although it can now be shown that there is a basic problem with the use of the speech spectrogram for voice analysis, the primary problem appears to be that the exclusive use of the spectrograph for speech analysis confines the concept of the speech signal to a spatio-temporal display. Such a spatio-temporal display is now realized to be quite unlike the signal as it exists in space. An acoustic speech signal does have spatial property, but they are not necessarily related to the spatial separation frequencies manifested in the speech spectrogram. The acoustic speech signal is a frequency-integrated, complex waveform whose actual spatial properties are indicated by radiation and reflection, not by frequency. The acoustic world we live in is not fully represented by a speech spectrogram.

Heretofore, the reliance on the speech spectrograph as the sole source of information about the speech signal has restricted observations to an analog of the neural output of the cochlea. This has resulted in the missing of the hypothesized higher order free integration stage of perceptual analysis. It is now understood that a more complete analysis of a speech signal requires a study of the speech waveform in addition to the spectrogram. The spectrogram provides the components of the signal (spatial) and the waveform shows how the components are integrated in time and space.

A feature of the present invention is to provide apparatus for analyzing the speech waveform for kinds of information not readily observable from the spectrogram. Further, by the apparatus of the present invention, information available from the speech waveform can be applied to practical problems in speech science. Specifically, by examining the speech waveform, there is developed a real time speaker independent pitch extractor with a voice pitch display. Further, an examination of the speech waveform has been applied to the invention described and claimed in the co-pending patent application entitled, "Tactile Aid", Ser. No. 048,237, filed June 13, 1979, which is apparatus for speech reception aid for the deaf. A tactile aid to speech reception as described in this co-pending application is a device which presents information about the speech signal to the observer through the skin.

In accordance with the present invention, there is provided apparatus for integrating redundant acoustic information in time. Such apparatus provides a technique for duplicating the operation of the perceptual system for integrating the periodicity of several spectral channels to aid in the perception of pitch frequencies. The apparatus of the present invention utilizes the basic principle that no matter how the speech signal is filtered, it will always have the periodicity of the fundamental frequency. This is due to the fact that all the resonances of the vocal tract are excited by the same source function and therefore must have the same periodicity. The system of the present invention evaluates true spectral pitch, that is, the periodicity of the fundamental component of a speech signal as an aid in the perception of speech.

Apparatus of the present invention operates on the premise that the common periodicities seen across spectral channels in response to a vowel sound are reflected in neural responses. A feature of the apparatus of the present invention is that it makes use of the observation that the amplitudes of the signals across the basilar membrane will be greatest at the beginning of each fundamental period of a speech signal and that the perceptual systems takes advantage of this redundancy about the pitch frequency of a sound signal. The system of the present invention adds waveforms in low frequency channels to take advantage of the redundancy about the pitch frequency.

DISCLOSURE OF THE INVENTION

Acoustic components of a speech signal are analyzed by apparatus that includes a low pass filter array with each filter of the array responsive to all the acoustic components of the speech signal which is representative of a human voice. The output of each filter of the array is summed into a composite signal, and this composite signal is applied to an input of one or more multipliers in sequence for multiplying the composite signal with one or more preset offset signals. The output of the last multiplier of the sequence is compared with a hysteresis signal and the result of this comparison is input to a phase locked loop. The phase locked loop responds to the result of the comparison to generate an output varying with the acoustic components of the speech signal.

Further in accordance with the present invention, a display device responds to the output of the phase locked loop to provide a visual indication of the acoustic component of the speech signal.

BRIEF DESCRIPTION OF THE DRAWINGS

A more complete understanding of the present invention and its advantages may be had from the following description when read in connection with the accompanying drawings.

Referring to the drawings.

DETAILED DESCRIPTION

Figure 1:
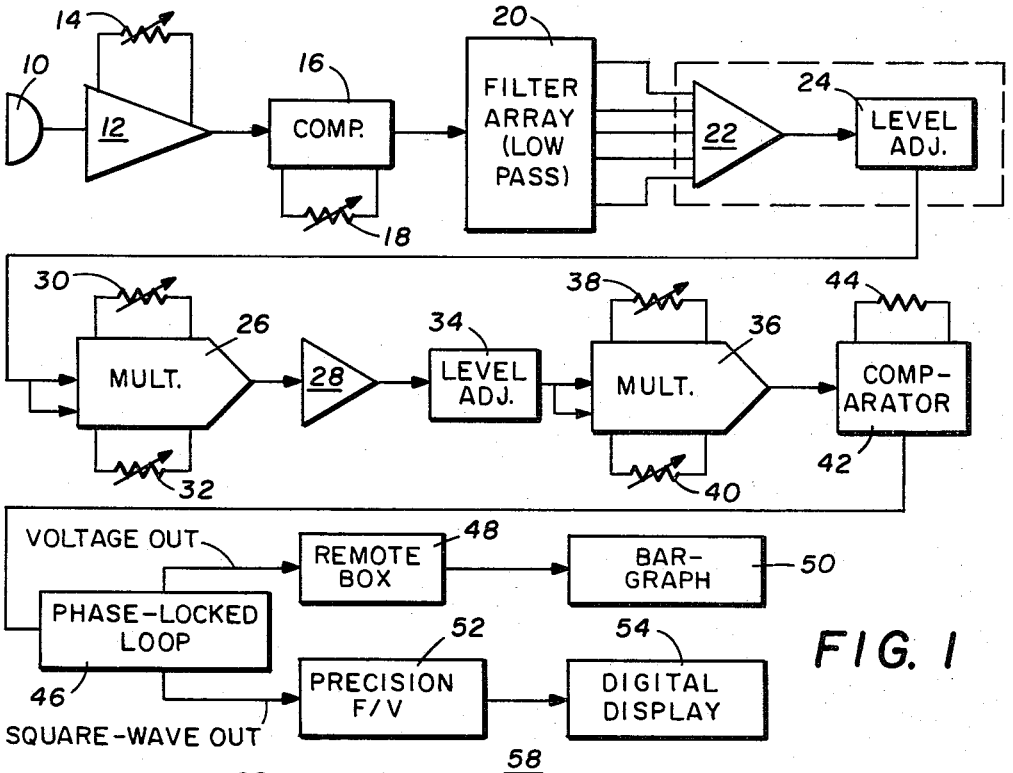
FIG. 1 is a block diagram of a voice pitch detector with a voice pitch display.

Referring to FIG. 1, a voice signal (acoustic signal) is received by a microphone 10 that provides an input to a preamplifier 12 with an adjustable CMRR that includes a variable resistor 14. An output of the amplifier 12 is applied to an input of a signal compressor 16 that is connected to a DC level control 18 consisting of a variable resistor for adjusting the low level compressor sensitivity of the compressed signal output. Connected to the output of the signal compressor 16 is a filter array 20 which in the present embodiment comprises five low pass filters having selected cutoff frequencies.

Each of the filters of the array 20 responds to all the components of the acoustic signal from the signal compressor 16 and generates an output having a selected frequency component to a summing amplifier 22. As illustrated in FIG. 1, five inputs to the summing amplifier 22 are combined into a composite signal output that is applied to a level adjusting network 24. The level adjusting network 24 modifies the amplitude of the output of the summing amplifier 22 for further processing in a multiplier chain.

In FIG. 1, the multiplier chain includes a first multiplier 26 connected to the output of the level adjusting network 24 and having an output applied to a buffer amplifier 28. Connected to the multiplier 26 are two offset controls 30 amd 32 consisting of variable resistors. The offset controls 30 and 32 are used to inject constants into the multiplying process, that is, constants for multiplication with the composite acoustic signal output from the summing amplifier 22. The offset signals are preset by means of the variable resistors during an initialization for operation of the apparatus by the present invention.

An output of the buffer amplifier 28 is input to a level adjusting network 34 that again modifies the amplitude of the composite signal, as now processed through the multiplier 26. The output of the level adjusting network 34 is connected to a multiplier 36 which is a second multiplier in the chain of the apparatus illustrated. Connected to the multiplier 36 are offset controls 38 and 40 each consisting of a variable resistor. These offset controls for the multiplier 36 function in an identical manner as the offset controls 30 and 32 of the multiplier 26.

While the system of FIG. 1 shows two multipliers, it should be understood that the invention is not so limited. Further, the number of offset controls in the chain of multipliers may be varied in accordance with the desired signal analysis for pitch extraction.

Connected to the output of the multiplier 36 is a comparator amplifier 42 that includes a hysteresis control 44 comprising a variable resistor. The comparator 42 compares the output of the multiplier 36 with the signal established at the hysteresis control 44 to generate an output signal to a phase locked loop 46. The phase locked loop provides two outputs, one an analog voltage representing pitch (frequency in Hertz) of the speech signal detected by the microphone 10 and a second signal in the form of a square wave at a frequency varying with the pitch frequency.

The analog output of the phase locked loop 46 is input to a remote control 48 that adjusts and controls the analog output of the phase locked loop for application to a bar graph display 50. The square wave output of the phase locked loop 46 is input to a frequency-to-voltage converter 52 that provides an output voltage varying with the input frequency. This output voltage is applied to a digital display 54 that provides a numeric representation of voice pitch (frequency in Hertz).

Figure 2:
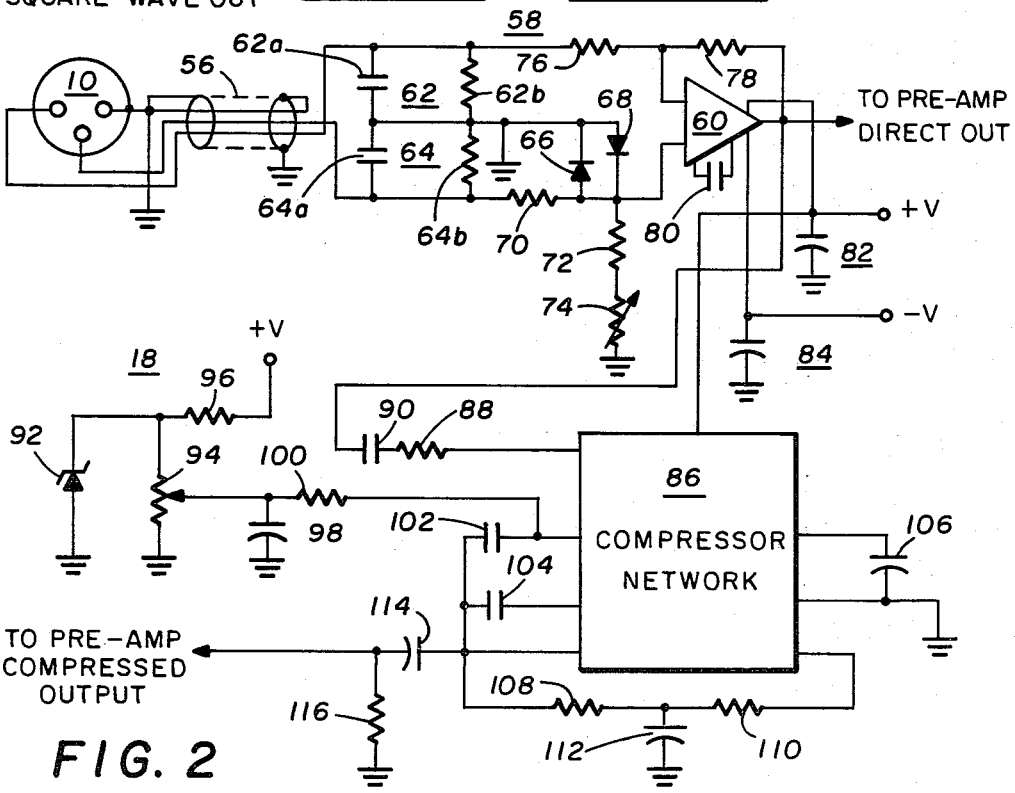
FIG. 2 is a schematic diagram of the input section of the system of FIG. 1.

Referring to FIG. 2, there is shown in detail the preamplifier 12 connected to the signal compressor 16 wherein the microphone 10 is connected by means of a shielded cable 56 to an input circuit 58 for a differential amplifier 60. Included as a part of the input circuit 58 are filters 62 and 64 with the former consisting of a capacitor 62*a* in parallel with a resistor 62*b* and the latter consisting of a capacitor 64*a* parallel with resistor 64*b*. The interconnection of the resistors and capacitors of the filters 62 and 64 are tied to the ground along with diodes 66 and 68. The diodes 66 and 68 in combination with resistors 70 and 72 and a variable resistor 74 provide circuitry for adjusting the CMRR of the differential amplifier 60. The CMRR may be adjusted by means of the variable resistor 74. The diodes 66 and 68, in conjunction with the diodes internal to 60 provide input clamping protection.

Connected to the inverting terminal of the amplifier 60 is an input resistor 76 and a feedback resistor 78, with the latter connected to the output of the amplifier in a feedback arrangement. Also connected to the amplifier 60 as a part of a feedback network is a capacitor 80. The amplifier 60 is driven by the output of a power supply (not shown) connected to supply circuits 82 and 84.

Connected to the output of the amplifier 60 is a compressor network 86 as part of the signal compressor 16. An example of a compressor network is the commercially available unit from Signetics and identified by Part No. NE570. When utilizing such a compressor network in the circuit as shown, the output of the amplifier 60 is connected to pin 6 through an input resistor 88 in series with a coupling capacitor 90. Connected to pin 13 of the compressor network 86 is the supply voltage at the supply circuit 82.

Connected to pin 3 of the compressor network 86 is the DC level control 18 consisting of a Zener diode 92 in parallel with a variable resistor 94 and connected to a voltage supply through a resistor 96. The wiper arm of the variable resistor 94 is connected to an RC network consisting of a capacitor 98 and a resistor 100. A resistor 100 also connects to pin 3 of the compressor network 86 and to a capacitor 102 which is also tied to pin 7. Pin 7 is the output terminal of the compressor network. Also connected to pin 7 and to pin 2 is a capacitor 104. Pin 1 of the compressor network 86 is tied through a capacitor 106 to ground and pin 4 is also grounded. Pins 5 and 7 are interconnected through resistors 108 and 110 to ground by means of a capacitor 112. The output of the compressor network 86 as generated at pin 7 is coupled to the filter array 20 through an RC network consisting of a capacitor 114 and a resistor 115.

Figure 3:
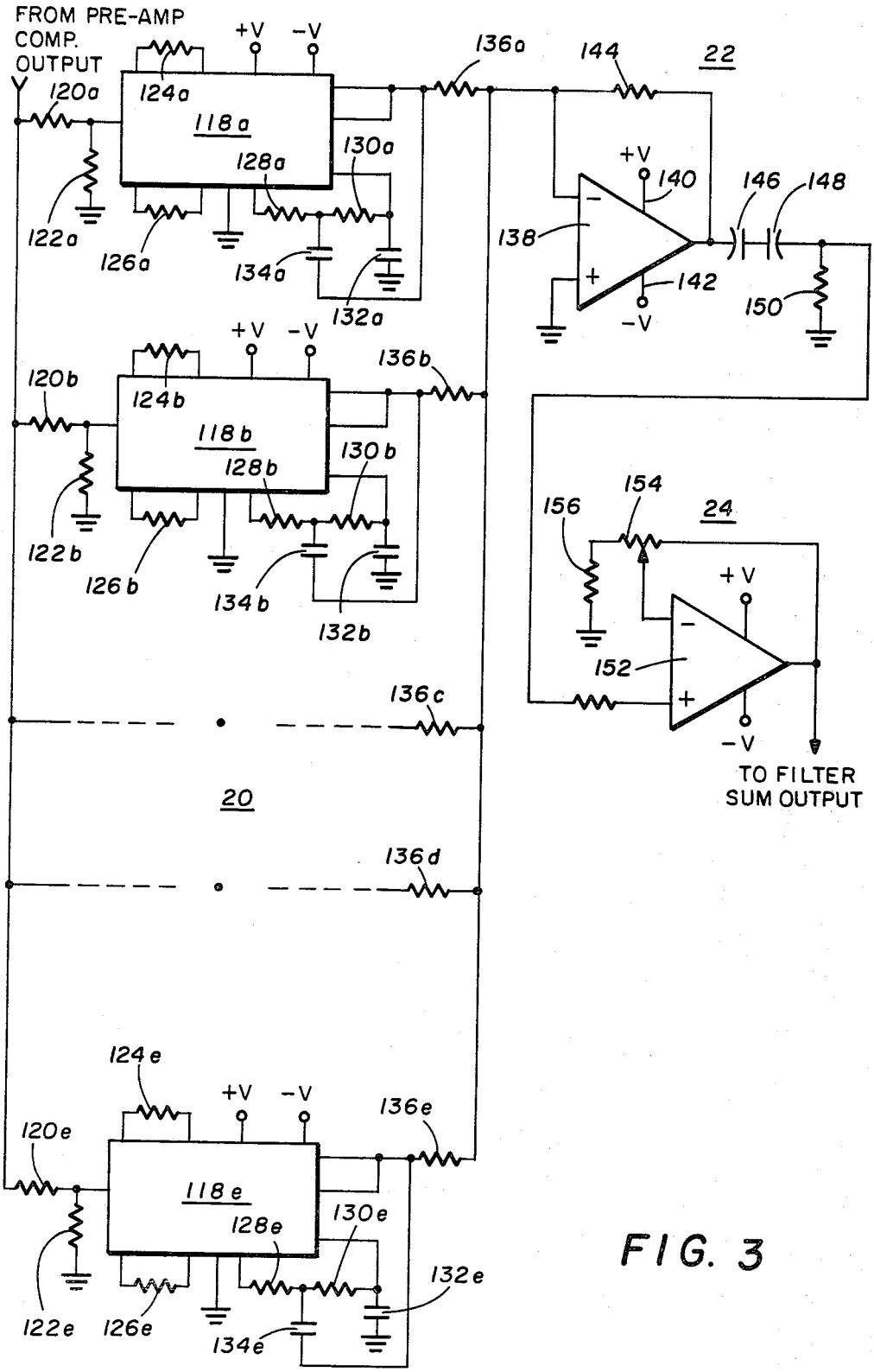
FIG. 3 is a schematic diagram of a filter array and composite signal summer for use in apparatus of the present invention.

Referring to FIG. 3, the interconnection of the capacitor 114 and resistor 116 as the output of the signal compressor 16 is tied to input circuits of filters 118*a* through 118*e* of the filter array 20. For purposes of simplifying FIG. 3, filters c and d have been omitted. It should be understood that the circuit details for these two filters will be the same as illustrated for filters 118*a*, 118*b* and 118*e*.

The preamplified and compressed output from the signal compressor 16 is supplied to the filter 118*a* through an input circuit consisting of resistors 120*a* and 122*a*. The interconnection of the resistors 120*a* and 122*a* is tied to pin 1 of the filter which typically may be a hybrid universal output filter identified by the Part No. ACF7092. Connected to pins 3 and 14 of the filter 118*a* is a frequency selective resistor 124*a* and connected to pins 7 and 13 is a frequency selective resistor 126*a*. These two resistors along with resistors 128*a* and 130*a* in a circuit with capacitors 132*a* and 134*a* establish the response frequency of the filter 118*a*. The resistors 128*a* and 130*a* are interconnected to pins 5 and 6 with pin 6 also connected to the capacitor 132*a*. The capacitor 134*a* is tied to the interconnection of the resistors 128*a* and 130*a* and is also tied to pins 10 and 11 which are the output terminals of the filter. The output of the filter 118*a* is applied through resistor 136*a* to an input of a differential amplifier 138 as part of the summing amplifier 22.

Refer now to filters 118*b* and 118*e* the resistors and capacitors interconnected to these filters are the same as described with reference to the filter 118*a*. Also, the pin connection for each of the filters in the array 20 is as described with reference to the filter 118*a*. To avoid duplication of description, the reference numbers for the filters 118*b* and 118*e* are the same as used in describing the filter 118*a*, with the exception of the letter designation associated with each individual filter.

The output of each of the filters a through d is connected to a summing network consisting of resistors 136*a* through 136*e*.

To analyze the pitch of the speech signal input to the microphone 10, the frequency components must be identified in the filter array. To identify these components of the acoustic signal, each of the filters 118*a* through 118*e* has a different center frequency. To establish the center frequency for the filters of FIG. 3, the resistors 124, 126, 128 and 130 along with the capacitors 132 and 134 are individually selected. For one embodiment of the filter array 20, Table 1 is a component chart with the center frequency for filter 118*a* established at 100 Hz, for filter 118*b* the center frequency is 200 Hz, for filter 118*c* the center frequency is 350 Hz, for filter 118*d* the center frequency is 500 Hz, and for filter 118*e* the center frequency is 650 Hz. With regard to the capacitors 132 and 134 they are selected to have a ratio of 2:1.

TABLE 1

| | COMPONENT CHART (Low Pass Filters) | | | | | | |
|---|---|---|---|---|---|---|---|
| FILTER | FREQ. | 124 | 126 | 128 | 130 | 134 | 132 |
| 118a | 100 Hz | 470K | 470K | 15K | 15K | 0.1 | 0.047 |
| 118b | 200 Hz | 220K | 220K | 12K | 12K | 0.068 | 0.033 |
| 118c | 350 Hz | 120K | 120K | 220K | 220K | .0022 | .001 |
| 118d | 500 Hz | 82K | 82K | 150K | 150K | .0022 | .001 |
| 118e | 650 Hz | 68K | 68K | 120K | 120K | .0022 | .001 |

Each of the resistors 136*a* through 136*e* is interconnected to the inverting input terminal of the differential amplifier 138 that has a noninverting terminal grounded. The amplifier 138 is connected to a power supply at terminals 140 and 142. A feedback network for the amplifier 138 consists of a resistor 144 and the output is tied to an RC network consisting of capacitors 146 and 148 and a resistor 150.

The interconnection of the capacitor 148 and the resistor 150 is tied to the noninverting input terminal of a differential amplifier 152 as part of the level adjusting network 24. The inverting input terminal of the amplifier 152 is tied to the wiper arm of a variable resistor 154 that is part of the feedback network for the amplifier. The inverting input terminal also connects to a bias resistor 156. By means of the variable resistor 154, the level of the composite signal resulting from the summation of the outputs of the filters 118*a* through 118*e* is adjusted for processing in the multiplier chain.

Figure 4:
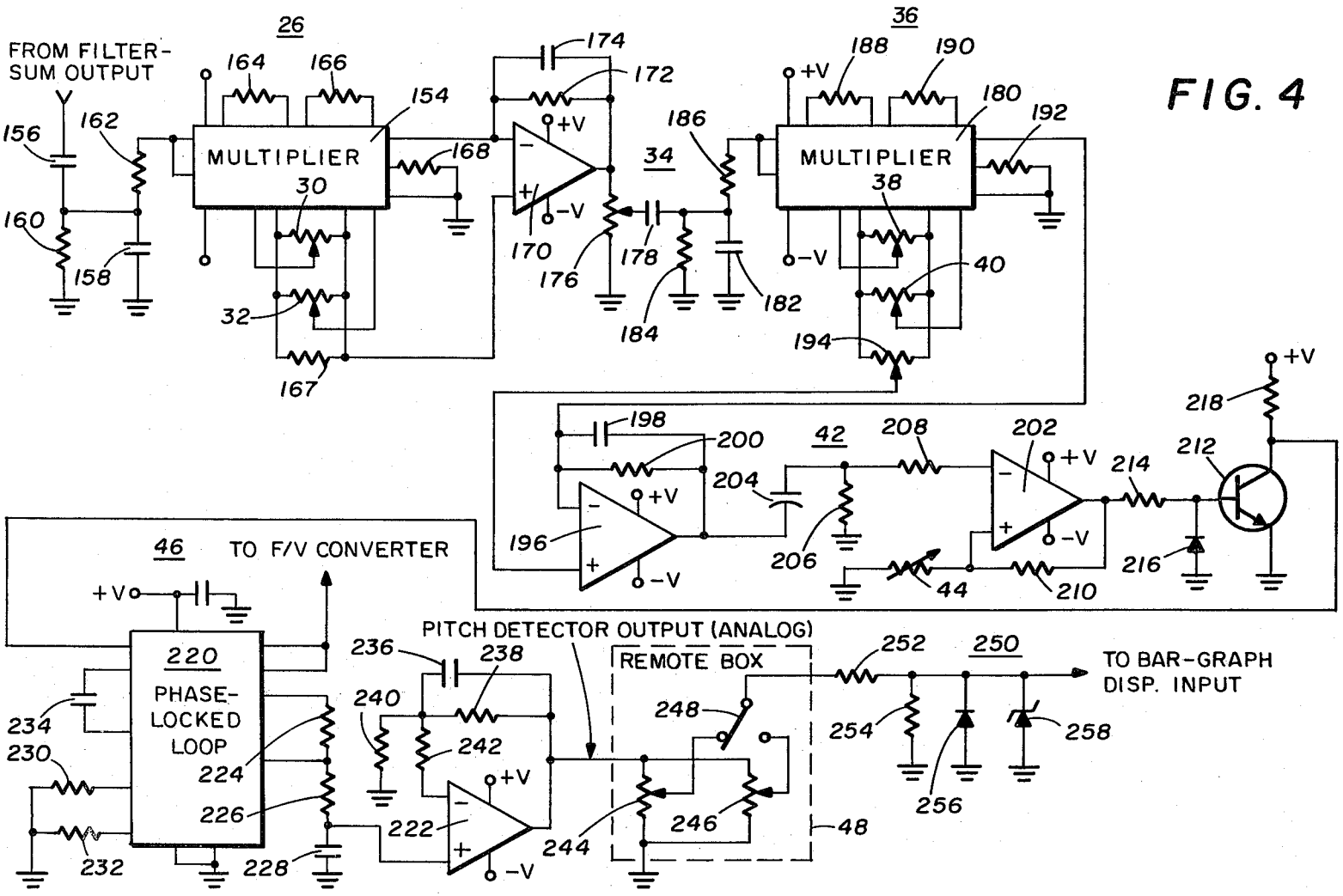
FIG. 4 is a schematic diagram of the multiplier chain of FIG. 1 including an amplifier for comparing the multiplier output with a hysteresis signal and including the phase locked loop and display of FIG. 1.

Referring to FIG. 4, there is shown the multiplier chain of FIG. 1 with the output of the differential amplifier 152 tied to the input of a multiplier circuit 154 through an input network consisting of capacitors 156 and 158 along with resistors 160 and 162 which together comprise the multiplier 26. One example of a multiplier circuit is a commercially available unit from MOTOROLA identified by the Part No. MC1594L. With this model of multiplier circuit, the input is connected to pins 9 and 10. Connected to pins 11 and 12 is a resistor 164 and connected to pins 7 and 8 is a resistor 166, both of which are also a part of the multiplier 26 and establish the multiplying factors of the multiplier circuit 154. Offset controls for the multiplier circuit 154 are connected to pins 2 and 4 and consist of variable resistors 165 and 167 and a fixed resistor 169. The wiper arm of the resistor 165 is tied to pin 6 while the wiper arm of the resistor 167 is tied to pin 13. Pin 1 on the multiplier circuit 154 is connected through a resistor 168 to ground and pin 3 has a direct connection to ground.

Pins 2 and 14 of the multiplier circuit 154 are connected to the inverting and noninverting input terminals, respectively, of a differential amplifier 170 that functions as the buffer 28. A feedback network for the differential amplifier 170 includes a resistor 172 in parallel with a capacitor 174. This parallel combination of resistor and capacitor is interconnected between the output terminal and the inverting input terminal of the amplifier 170.

As connected, the amplifier 170 functions as a current-to-voltage converter that provides an input to the level adjusting network 34. Specifically, the output of the amplifier 170 is connected to a variable resistor 176 having a wiper arm connected through a coupling capacitor 178 as part of an input network to a multiplier circuit 180 which comprises the multiplier 36. Also forming a part of the input network is a capacitor 182 and resistors 184 and 186. By implementing the multiplier circuit 180 with the same commercially available unit as the multiplier circuit 154, a similar interconnection of components to pins is illustrated. Resistors 188 and 190 are thus connected to pins 11 and 12, and pins 7 and 8, respectively. Pins 2 and 4 are connected to offset controls 38 and 40 with the wiper arm of the offset control 38 connected to pin 6 and the wiper arm of the offset control 40 connected to pin 13. A resistor 192 connects pin 1 to ground and pin 3 is grounded. Also connected to pins 2 and 4 is a variable resistor 194 that provides a means for adjusting the DC output level from the multiplier circuit 180. The wiper arm of this resistor is connected to the noninverting input terminal of a differential amplifier 196.

Connected to the inverting input terminal of the amplifier 196 is the pin 14 of the multiplier circuit 180. The amplifier 196 functions as a current-to-voltage converter as a part of the comparator 42 and includes as a feedback network a capacitor 198 in parallel with a resistor 200. Connected to the output of the amplifier 196 is an input network for a differential amplifier 202 that is also a part of the comparator 42. The input network includes a coupling capacitor 204 and resistors 206 and 208. The noninverting input terminal of the amplifier 202 is tied to the hysteresis control resistor 44 and to a feedback resistor 210 which is also connected to the output of the amplifier.

The amplifier 202 drives a unipolar pulse generator that consists of a transistor 212 connected to the output of the amplifier through a base drive resistor 214. A base bias is established for the transistor 212 by means of a diode 216 connected to the resistor 214. A voltage supply is connected to the unipolar pulse generator through a resistor 218 at the collector electrode of the transistor which is also the output terminal.

Connected to the collector electrode of the transistor 212 is a phase locked loop circuit 220 as part of the phase locked loop 46. As implemented in FIG. 4, the phase locked loop circuit 220 is an integrated circuit package commercially available from RCA, and identified by the Part No. CD4046. The input to the phase locked circuit 220 is at pin 14 with one output generated at pins 3 and 4 and a second output generated at pins 9 and 13. The output of the circuit 220 at pins 3 and 4 is a square wave having a frequency related to the acoustic components of the speech signal input to the microphone 10. The output of the circuit 220 at pins 9 and 13 is connected to an input network for a differential amplifier 222 where the input network consists of resistors 224 and 226 in series with a capacitor 228. Also connected to the phase locked loop circuit 220 at pins 11 and 12, respectively, are resistors 230 and 232. Pins 6 and 7 of the phase locked loop circuit are interconnected through a capacitor 234.

The second output of the phase locked loop 46, as described with reference to FIG. 1, is generated at the output of the differential amplifier 222. This output is also fed back to the inverting input terminal by means of a feedback network consisting of a capacitor 236 in parallel with a resistor 238. Also connected to the inverting input terminal of the amplifier 222 are resistors 240 and 242.

The output of the differential amplifier 222 is the analog output of the voice pitch detector and represents the pitch (frequency in Hertz) of the voice signal input to the microphone 10. This output is interconnected through the remote control 48 that consists of variable resistors 244 connected in parallel with the wiper arm of each variable resistor connected to one terminal of a momentary push button switch 248. The common terminal of the switch 248 is interconnected to a display driver 250 that includes resistors 252 and 254 with a diode 256 in parallel with the resistor 254. In parallel with the diode 256 is a Zener diode 158 for establishing a base voltage for driving the bar graph display 50.

Figure 5:
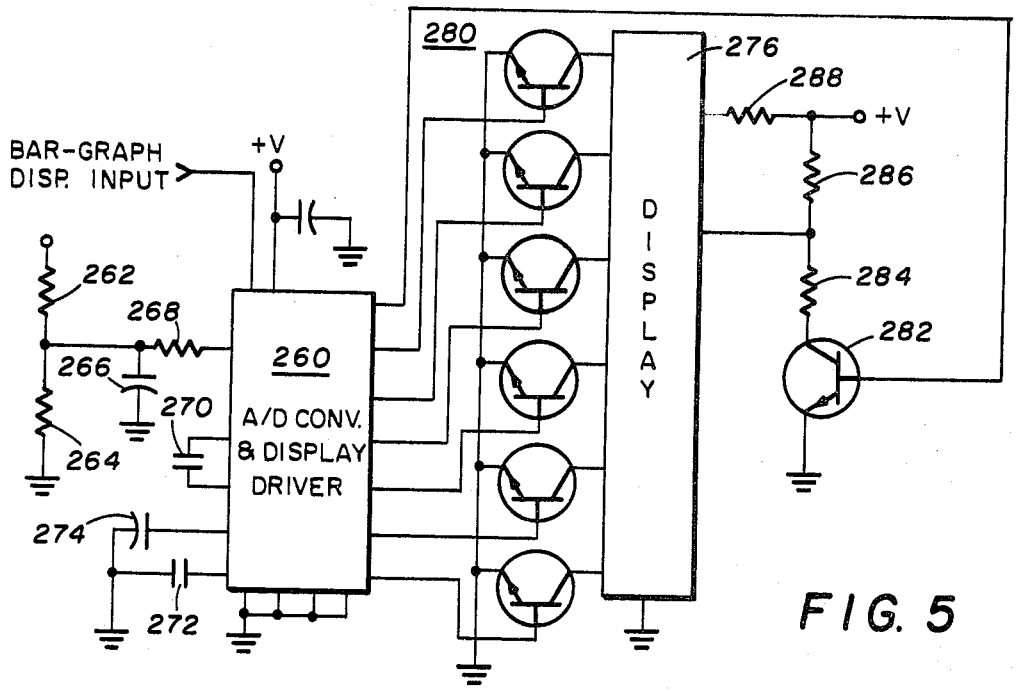
FIG. 5 is a schematic diagram of a bar graph display for use with apparatus of the present invention.

Referring to FIG. 5, there is shown in detail the bar graph display 50 with the output of the driver circuit 250 connected to an analog-to-digital converter and display driver 260. A second input circuit to the driver 26 consists of a voltage divider comprising resistors 262 and 264 with the interconnection of these resistors tied to a capacitor 266 and a resistor 268. In one implementation of the analog-to-digital converter and display driver, a commercially available unit from NATIONAL, Part No. CC3580F was utilized.

Connected to pins 6 and 8 is a capacitor 270 with pins 4 and 9 connected to ground through capacitors 272 and 274, respectively. Output voltages from the display driver 260 drive a bar graph display 176 and are generated at pins 1, 2, 16, 17 and 20 through 22. Pins 1, 2, 17 and 20 through 22 drive the display 276 through individual transistors of an array 280.

The pin numbers illustrated in FIG. 5 are for a Burroughs bar graph self scan display, Model No. BG12205-2. Pin number 16 of the driver 260 provides a base drive to a transistor 282 having a collector electrode connected through a resistor 284 to pin 1 of the display 276 and to a DC voltage supply through a resistor 286. Also connected to the voltage supply is pin 5 of the display 276 through a resistor 288.

Figure 6:
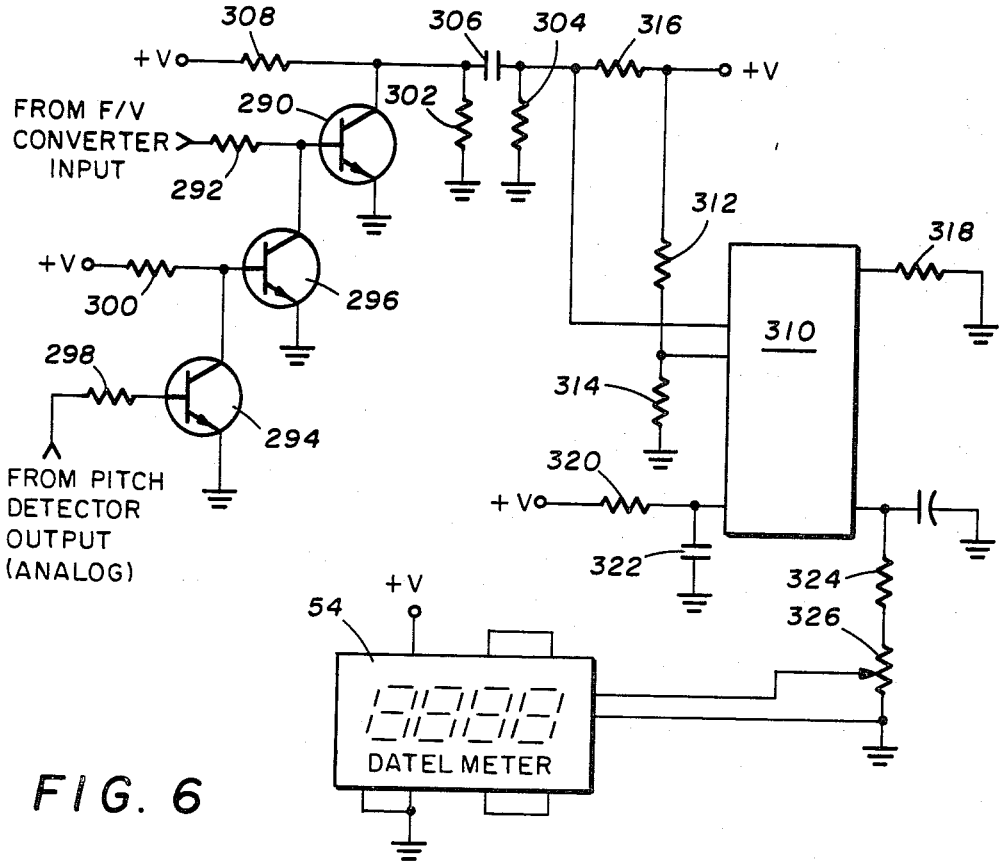
FIG. 6 is a schematic diagram of a linear frequency voltage converter for driving a numerical display indicating voice pitch (frequency in Hertz).

Referring to FIG. 6, the square wave output of the phase locked loop 46 is input to the base electrode of a transistor 292. The transistor 292 is the third stage of a transistor amplifier that also includes transistors 294 and 296. Transistor 294 is driven by the analog output of the amplifier 222 through a base drive resistor 298. Transistor 296 is driven by the output of the transistor 294 and has the base electrode biased from a DC supply through a resistor 300.

An output of the transistor 292 is generated at the collector electrode and applied to a filter network consisting of resistors 302 and 304 and a capacitor 306. Also connected to the collector electrode of the transistor 292 is a drive resistor 308. The output of the filter at the connection of resistor 304 and capacitor 306 is connected to a frequency-to-voltage converter circuit 310 at pin 6. Typically, the converter 310 is a commercially available unit from RAYTHEON, Part No. 4151. Pin 7 of the converter 310 is connected to a voltage divider network including resistors 312 and 314, with the former connected to a voltage supply. Also connected to the voltage supply is a resistor 316 for establishing the current level of the input signal to the converter 310. Pin 2 of the converter 310 is connected to ground through resistor 318 and pin 4 is connected directly to ground. Also connected to the converter 310 is a resistor 320 connected to a capacitor 322.

The output of the converter 310 is applied to a calibration circuit including a resistor 324 in series with a variable resistor 326. In parallel with the resistors 324 and 326 is a capacitor 328. The output of the converter 310 at the wiper arm of the variable resistor 326 is a voltage varying with frequency which may typically be 1 millivolt/Hz. This output is connected to the digital display 54 which gives a numerical indication of voice pitch (frequency in Hertz). Typically, the display 54 is a model DM4100 commercially available under the name Datel Meter. The interconnection of this model of display meter is illustrated in the figure.

In operation of the circuit of FIG. 1, the voice pitch of a speech signal input to the microphone 10 is passed through the filter array 20 and connected to the multiplier chain. The multiplier chain provides offset voltages to the composite output from the summing amplifier 22. An output of the multiplier chain is compared with a hysteresis voltage and input to a phase locked loop 46. One output of the phase locked loop 46 generates a hard copy display in a bar graph format in the bar graph recorder 276. A second output of the phase locked loop is converted from a frequency to a voltage varying with frequency by means of the converter 310 for driving the numeric display 54.

Although one embodiment of the invention has been illustrated in the accompanying drawings and described in the foregoing detailed discription, it will be understood that the invention is not limited to the embodiment disclosed, but is capable of numerous rearrangements, modifications and substitutions without departing from the scope of the invention.

We claim:

1. Apparatus for analyzing the acoustic components of a speech signal, comprising:

a low pass filter array, each filter of the array responsive to all of the acoustic components of a speech signal representative of human voice and passing selected speech frequencies to an output, means for summing the output of each filter into a composite signal, multiplication means connected to the output of said means for summing for multiplying the composite signal with at least one preset offset signal, circuit means having one input connected to receive a hysteresis signal and a second input connected to the output of said multiplication means to compare the output of said multiplication means with the hysteresis signal, and a phase locked loop responsive to the output of said means for comparing to generate an output representing the acoustic components of the speech signal.

2. Apparatus for analyzing the acoustic components of a speech signal as set forth in claim 1 including a converter connected to said phase locked loop, and a digital display responsive to the voltage output of said converter.

3. Apparatus for analyzing the acoustic components of a speech signal as set forth in claim 1 including a current-to-voltage converter connected between said multiplication means and said circuit means for connecting the output of said multiplication means to said circuit means.

4. Apparatus for analyzing the acoustic components of a speech signal as set forth in claim 1 including a unipolar pulse generator connected between said circuit means and said phase locked loop to convert the output of said means for comparing into a pulse signal to said phase locked loop.

5. Apparatus for analyzing the acoustic components of a speech signal as set forth in claim 1 wherein said multiplication means includes means for generating the offset signals for multiplication with the composite signal.

6. Apparatus for analyzing the acoustic components of a speech signal as set forth in claim 5 wherein said means for generating the offset signal includes means for adjusting the preset level of the offset signal.

7. Apparatus for analyzing the acoustic components of a speech signal as set forth in claim 1 wherein said filter array includes a first filter having a cut off frequency of 100 Hz, a second filter having a cut off frequency of 200 Hz, a third filter having a cut off frequency of 350 Hz, a fourth filter having a cut off frequency of 500 Hz and a fifth filter having a cut off frequency of 650 Hz.

8. Apparatus for analyzing the acoustic components of a speech signal, comprising:

a low pass filter array, each filter of the array responsive to all the acoustic components of a speech signal representative of a human voice and passing selected speech frequencies to an output, means for summing the output of each filter into a composite acoustic signal, a first multiplier connected to the means for summing for multiplying the composite signal with a preset offset signal, a second multiplier responsive to the output of said first multiplier for multiplying the output thereof by a preset offset signal, circuit means having one input receiving a hysteresis signal and another input connected to the second multiplier to compare the output of the second multiplier with the hysteresis signal, and a phase locked loop responsive to the output of said means for comparing and varying with the acoustic component of the speech signal.

9. Apparatus for analyzing the acoustic components of a speech signal as set forth in claim 8 wherein each multiplier includes means for adjusting the preset offset signal.

10. Apparatus for analyzing the acoustic components of a speech signal as set forth in claim 8 wherein said circuit means includes means for adjusting the level of the hysteresis signal.

11. Apparatus for analyzing the acoustic components of a speech signal as set forth in claim 8 wherein each multiplier includes means for generating a second offset signal for multiplication with the composite signal.

12. Apparatus for analyzing the acoustic components of a speech signal as set forth in claim 11 wherein each said multiplier includes means for adjusting the second offset signal.

13. Apparatus for analyzing the acoustic components of a speech signal as set forth in claim 8 including means responsive to the analog output of said phase locked loop for providing a visual display of the acoustic components of the speech signal.

14. Apparatus for analyzing the acoustic components of a speech signal as set forth in claim 8 wherein said filter array includes a first filter having a cut off frequency of 100 Hz, a second filter having a cut off frequency of 200 Hz, a third filter having a cut off frequency of 350 Hz, a fourth filter having a cut off frequency of 500 Hz, and a fifth filter having a cut off frequency of 650 Hz.

15. Apparatus for analyzing the acoustic components of a speech signal as set forth in claim 14 wherein each said filter includes an RC network for establishing the filter frequency.

16. Apparatus for analyzing the acoustic components of a speech signal, comprising:

means responsive to the acoustic components of a speech signal representative of a human voice for generating a compressed acoustic signal, a low pass filter array with each filter of the array responsive to the compressed acoustic signal, means for summing the output of each filter of the filter array into a composite signal, multiplication means connected to the output of said means for summing for multiplying the composite signal with a plurality of preset offset signals, said multiplication means including means for establishing the plurality of offset signals, circuit means having one input connected to receive a hysteresis signal and a second input connected to the output of said multiplication means to compare the output of said multiplication means with the hysteresis signal, and a phase locked loop responsive to the output of said means for comparing to generate an output varying with the acoustic components of the speech signal.

17. Apparatus for analyzing the acoustic components of a speech signal as set forth in claim 16 wherein said circuit means includes means for adjusting the level of the hysteresis signal.

18. Apparatus for analyzing the acoustic components of a speech signal as set forth in claim 17 wherein each of said means for generating an offset signal includes means for adjusting the preset level of the offset signal.

19. Apparatus for analyzing the acoustic components of a speech signal as set forth in claim 18 including means responsive to the output of said phase locked loop for providing a hard copy readout of the acoustic components.

20. Apparatus for analyzing the acoustic components of the speech signal as set forth in claim 19 including a converter connected to said phase locked loop, and a digital display responsive to the voltage output of said converter.

21. Apparatus for analyzing the acoustic components of a speech signal as set forth in claim 20 wherein said filter means includes a first filter having a cut-off frequency of 100 Hz.

* * * * *